US010464700B2

(12) United States Patent
Rea et al.

(10) Patent No.: US 10,464,700 B2
(45) **Date of Patent: *Nov. 5, 2019**

(54) METHOD AND MACHINE FOR MAKING INTERMEDIATE COMPONENT OF SINGLE USE CAPSULES FOR BEVERAGES

(71) Applicant: GIMA, S.P.A., Zola Predosa (IT)

(72) Inventors: Dario Rea, Monterenzio (IT); Fabio Franceschi, Mordano (IT)

(73) Assignee: GIMA, S.P.A., Zola Predosa (IT)

( * ) Notice: Subject to any disclaimer, the term of this patent is extended or adjusted under 35 U.S.C. 154(b) by 873 days.

This patent is subject to a terminal disclaimer.

(21) Appl. No.: 14/405,728

(22) PCT Filed: Oct. 31, 2012

(86) PCT No.: PCT/EP2012/071551

§ 371 (c)(1),
(2) Date: Dec. 4, 2014

(87) PCT Pub. No.: WO2013/189556

PCT Pub. Date: Dec. 27, 2013

(65) Prior Publication Data

US 2015/0119220 A1 Apr. 30, 2015

(30) Foreign Application Priority Data

Jun. 20, 2012 (IT) ..... BO2012A0338

(51) Int. Cl.
*B65B 29/02* (2006.01)
*B65B 7/28* (2006.01)
(Continued)

(52) U.S. Cl.
CPC ..... *B65B 29/02* (2013.01); *B65B 7/164* (2013.01); *B65B 7/28* (2013.01); *B65B 29/022* (2017.08);
(Continued)

(58) Field of Classification Search
CPC ..... B65B 29/02; B65B 29/022; B65B 61/06; B65B 61/065; B65B 61/20; B65B 7/28;
(Continued)

(56) References Cited

U.S. PATENT DOCUMENTS 2,736,065 A * 2/1956 Wilcox ..... B29C 51/04 126/294
3,346,435 A 10/1967 Rudolf et al.
(Continued)

FOREIGN PATENT DOCUMENTS

EP 0 524 464 A1 1/1993
EP 1 167 204 A1 1/2002
(Continued)

*Primary Examiner* — Alexander M Valvis
*Assistant Examiner* — Mary C Hibbert-Copeland
(74) *Attorney, Agent, or Firm* — Pearne & Gordon LLP

(57) ABSTRACT

A method for making an intermediate component (11) of a single use capsule (1) for extraction or infusion beverages includes the step of: arranging a first strip (S1) of thermoformable filtering material above rigid bodies (2); joining the first strip (S1) of thermoformable filtering material to the rigid bodies (2) at respective rims (7); forming the first strip (S1) of thermoformable filtering material to achieve a filter (8) that defines a chamber (5) for a dose of product. A machine for making intermediate components of single use capsules (1) for extraction or infusion beverages includes: a feeding system (40); a transport system (50); a joining station (60); and a forming station (70).

14 Claims, 3 Drawing Sheets

(51) Int. Cl.

| | |
|---|---|
| ***B65D 85/804*** | (2006.01) |
| ***B65B 47/04*** | (2006.01) |
| ***B65B 61/06*** | (2006.01) |
| ***B65B 61/20*** | (2006.01) |
| ***B65B 7/16*** | (2006.01) |

(52) U.S. Cl.
CPC ..... *B65B 47/04* (2013.01); *B65B 61/06* (2013.01); *B65B 61/20* (2013.01); *B65D 85/8043* (2013.01); *B65D 85/8046* (2013.01)

(58) Field of Classification Search
CPC .. B65B 47/04; B65D 85/804; B65D 85/8043; B65D 85/8046
USPC ..... 493/344; 53/453, 558, 559, 561, 471, 53/282, 478, 329.3
See application file for complete search history.

(56) References Cited

U.S. PATENT DOCUMENTS 3,509,686 A * 5/1970 Bergstrom ..... B65B 31/021 53/511
3,851,445 A 12/1974 Schuh
4,024,694 A 5/1977 Cooper et al.
4,598,529 A 7/1986 Pongrass et al.
4,751,806 A 6/1988 Gram
4,859,337 A * 8/1989 Woltermann ..... A47J 31/02 210/474
4,965,986 A 10/1990 Klinkel
5,379,572 A 1/1995 Giovannone
5,551,207 A 9/1996 Beyer et al.
5,564,252 A 10/1996 Adelmann
5,577,370 A 11/1996 Pajak et al.
6,440,256 B1 8/2002 Gordon et al.
6,662,531 B1 12/2003 Schwab et al.
7,296,779 B2 11/2007 Bakshi et al.
7,910,145 B2 * 3/2011 Reati ..... B65B 29/022 426/425
8,276,639 B2 * 10/2012 Binacchi ..... B65B 29/02 156/443
8,875,478 B2 11/2014 Fitzgerald, IV et al.
9,221,227 B2 12/2015 Boldrini et al.
9,428,329 B2 8/2016 Trombetta et al.
2001/0008064 A1 7/2001 Todd et al.
2003/0079440 A1 5/2003 Luc et al.
2005/0224373 A1 10/2005 Bailey et al.
2007/0204567 A1 9/2007 Wintring et al.
2008/0299262 A1 12/2008 Reati
2009/0211713 A1 8/2009 Binacchi
2010/0256797 A1 10/2010 Conti
2011/0259205 A1 10/2011 Delorme
2012/0247072 A1 10/2012 Romijn et al.
2012/0269933 A1 10/2012 Rapparini
2012/0301581 A1 11/2012 Abegglen et al.
2013/0209618 A1 * 8/2013 Trombetta ..... B32B 1/02 426/115
2014/0109529 A1 4/2014 Hayakawa et al.
2014/0202120 A1 7/2014 Scrivani
2014/0230370 A1 8/2014 Bianchi
2015/0056340 A1 2/2015 Trombetta et al.
2015/0056341 A1 2/2015 Trombetta et al.
2015/0291347 A1 10/2015 Rivola
2015/0352044 A1 12/2015 Benson et al.
2016/0229570 A1 8/2016 Rea et al.
2016/0270591 A1 9/2016 Fujita et al.
2017/0086617 A1 3/2017 Hibi et al.

FOREIGN PATENT DOCUMENTS

EP 2 093 148 A1 8/2009
WO 2011/047836 A1 4/2011

* cited by examiner

METHOD AND MACHINE FOR MAKING INTERMEDIATE COMPONENT OF SINGLE USE CAPSULES FOR BEVERAGES

FIELD OF THE INVENTION

The present invention relates to a method and a machine for making intermediate components of single use capsules for beverages. In particular, the intermediate components referred to comprise a rigid body and a filtering element.

BACKGROUND OF THE INVENTION

There are known in the art single use capsules for extraction beverages of the type comprising, typically:

- a rigid body, cup-shaped, (usually, but not limiting, with a troncoconical shape) with a pierceable (or pre-pierced) bottom and an upper aperture provided with a rim;
- a filtering element to define a containing chamber;
- a dose of extraction product (for example in powder or granules) contained in the chamber and adapted to be contacted by a liquid under pressure;
- a closing lid for closing the upper aperture of the rigid body and the chamber, adapted (usually, but not limiting) to be pierced by a nozzle for filling liquid under pressure.

The illustrated capsule is used in machine for making beverages comprising a housing for the capsules.

The closing lid of the capsule is usually pierced by a nozzle for filling liquid under pressure (hot water) that distributes on the product contained in the chamber in order to obtain the beverage.

The bottom of the rigid body is pierceable by means of different types of organs, like sharpened and hollow elements, adapted to penetrate the bottom and to guide the so obtained beverage towards a delivery nozzle.

A method and machine for making capsules of the type illustrated is known from EP-A-2093148.

The method (and machine) illustrated in EP-A-2093148 provides for cutting a portion of filtering material, suitably shaping the portion, and joining the shaped portion to an internal wall of the rigid body by means of radial sealers in two successive sealing stations.

The method (and machine) illustrated in EP-A-2093148 is quite complicated, because of the shaping and joining steps. In particular, it is quite complicated to join the portion, already shaped, of the filtering material to the internal wall of the rigid body.

SUMMARY OF THE INVENTION

It is an object of the present invention to provide a method and a machine for making intermediate components of single use capsules for beverages that can be filled with a dose of product and closed with a closing lid in known filling and packaging machines.

It is a further object of the present invention to provide a method and a machine for making intermediate components of single use capsules for beverages that are simple and with high productivity.

The above objects are achieved by a method according to claim 1 and by a machine according to claim 10.

In particular, a method according to the invention provides for a step of positioning a first strip of filtering material above rigid bodies, fed singly or in form of a second strip of thermoformed alveolate material; a step of joining the first strip of filtering material to rims of the rigid bodies; and a step of forming the first strip of filtering material to form a filtering element that defines a chamber adapted to contain a respective dose of product.

At least one step of cutting is provided for downstream of the step of joining to cut at least the first strip of filtering material.

Thus, the method according to the invention provides for joining the filtering material to the rigid body and, only subsequently, forming the filtering material to define the chamber.

A machine according to the invention comprises, among others, a forming station arranged downstream of a joining station along an advancing direction.

The problem of accurate positioning the filtering element with respect to the rigid body of the known methods and machines, that provide for thermoforming the filtering material before joining the filtering element to the rigid body, is thus overcome by the method and machine of the invention.

The method and machine according to the invention simplify the step of positioning and joining the filtering element to the rigid body, as they provides for operating on plane surfaces both of the filtering element (fed through the first strip) and of the rigid body, in particular of the rim.

Moreover, the method and machine according to the invention provide for cutting the filtering material only after the first strip is joined to the rim of the rigid body, so achieving an easier cutting of the filtering material, as the rim of the rigid body acts as an abutment element.

BRIEF DESCRIPTION OF THE FIGURES

These and other advantages of the invention will be clearly illustrated in the following detailed description and drawings of preferred embodiments, given by way of non limiting examples, wherein.

DETAILED DESCRIPTION OF THE INVENTION

A method according to the invention is carried out for making intermediate components 11 of single use capsules 1 for beverages of the extraction or infusion type.

Figure 3:
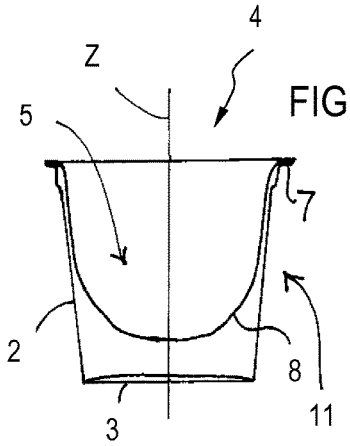
FIG. 3 illustrates the intermediate component made with the method and machine according to the invention.

In particular (see FIG. 3), the intermediate component 11 includes a rigid body 2, that extends along a main direction Z, cup shaped and featuring a bottom 3 and an upper aperture, or mouth, 4. The bottom 3 can be closed and pierceable, or pre-pierced.

The rigid body 2, preferably, features a troncoconical section with the bottom 3 having smaller dimension that the upper aperture 4.

The upper aperture 4 is delimited by a rim, or collar, 7, that features an upper surface perpendicular to the main direction Z. Preferably, the rim 7 is circular and extends radially. The intermediate component 11 further includes a filtering element, or filter, 8 engaging the upper aperture 4 and configured so as to extend, with a concave section, within the rigid body 2 to define a chamber 5 adapted to contain a dose D of product, for example in powder or granules. In particular, the filtering element 8 is coupled to the rim 7 of the upper aperture 4 of the rigid body 2. The filtering element 8 is made of formable material, advantageously thermoformable material.

Figure 4:
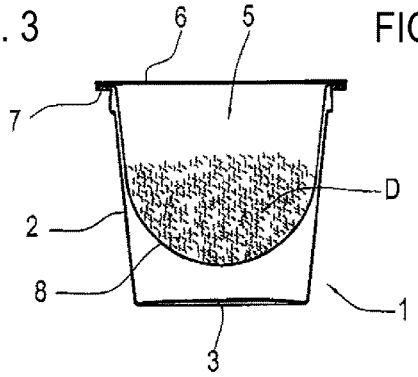
FIG. 4 is a front view, with some parts cut away for sake of clearness, of a single use capsule for beverages including the intermediate component of FIG. 3.

The intermediate component 11 can be used, according to known method, in filling and packaging machines, to make capsules 1 of the type illustrated in FIG. 4.

The capsule 1 further includes a closing lid 6 that closes the upper aperture 4 along the rim 7. The closing lid 6 can be associated to the rim 7 only, or to the rim 7 and the filtering element 8, or the filtering element 8 only.

The closing lid 6 can be rigid or flexible, air-tight or pre-pierced, depending on the machine for making beverages in which the capsule 1 is used.

The filtering element 8 allows to retain the dose D of product and to filter the beverage obtained towards the bottom 3 of the rigid body 2.

The bottom 3, if closed, is in turn pierced by means of organs adapted to direct the so obtained beverage to delivery nozzles.

According to the invention, the method for making the intermediate component 11 of the capsule 1 includes, in sequence, the steps of (see FIGS. 1 and 2):

feeding a plurality of rigid bodies 2;

positioning a first strip S1 of thermoformable filtering material above the rigid bodies 2;

firmly joining the first strip S1 of thermoformable filtering material to the rigid bodies 2 at a joining zone along respective rims 7;

forming the filtering element 8 that defines the chamber 5 adapted to contain a dose D of product.

In the step of feeding, it is possible to feed the rigid bodies 2 singly, for example by means of movable drawers 9 onto which suitable seats are achieved for the rigid bodies 2.

Alternatively, in the step of feeding, it is possible to feed the rigid bodies 2 in form of a second strip S2 of thermoformed material comprising an orderly plurality of rigid bodies 2. The second strip S2 may be continuous or discontinuous to form an alveolate band, or a plurality of alveolate trays, respectively. Each tray may comprise a plurality of rigid bodies 2. For example, the second strip S2 can be moved by means of pull clamps 27 (schematically illustrated in FIG. 1), or by means of the movable drawers 9, or by means of suitable drawing rollers.

Depending on operative requirements of the filling and packaging machines to which the intermediate components are destined, the method according to the invention may comprise a step of cutting to achieve single intermediate components 11, or trays comprising a plurality of intermediate components 11.

In a preferred embodiment, a single step of cutting may be provided for downstream of the step of forming to cut the first strip S1 of filtering material and the rigid body 2 (if the latter is fed in form of the second strip S2) to achieve single intermediate components 11, or trays of intermediate components 11.

With such a succession of steps, it is possible to position and join the filter 8 to the rim 7 of the upper aperture 4 in an extremely simple and precise way, as in the step of positioning and in the step of joining the first strip S1 and the rim 7 contact at respective plane and mutually parallel surfaces.

The step of forming is carried out subsequently the step of joining. Advantageously, the step of forming provides for thermoforming the first strip S1 of thermoformable filtering material.

Only limited portions of the first strip S1 of thermoformable filtering material are involved in the step of forming, in particular the portions of the first strip S1 arranged at the upper apertures 4 of the rigid bodies 2 only.

Advantageously, the step of forming includes:

a first sub-step of forming, or step of pre-forming, for partially forming the filtering element 8 towards the interior of the rigid body 2, and a second sub-step of forming, or step of final forming, for completely forming the filtering element 8, so defining the chamber 5.

Advantageously, in the step of pre-forming (see FIGS. 5 and 7) an annular zone 8*a* of the filtering element 8, adjacent and internal to the joining zone, is affected by a plastic deformation.

Figure 6:
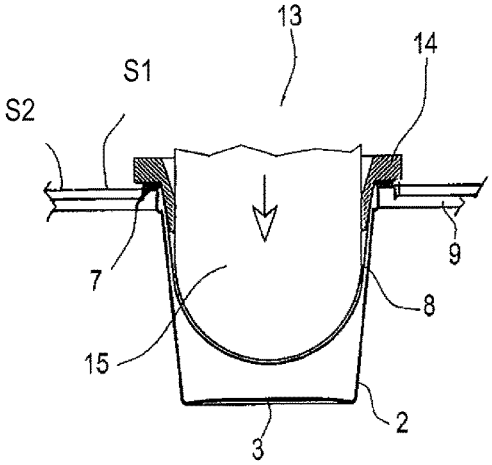
Figure 8:
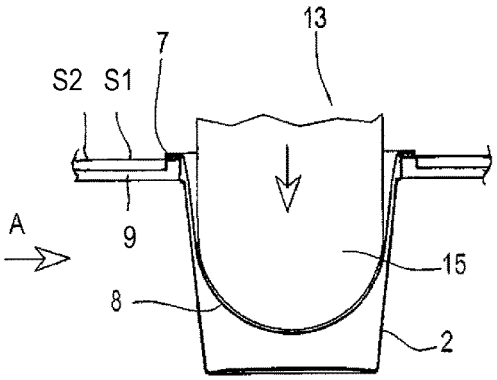

In the step of final forming, a central zone of the filtering element 8, internal to the annular zone 8*a*, is affected by a plastic deformation (see FIGS. 6 and 8).

The step of forming in two subsequent sub-steps allows to modulate the plastic deformation of the filtering material, so avoiding risks of fractures and cracks.

Preferably, the step of forming the filtering element 8 is achieved by means of heat transfer.

It has to be noted that both the first sub-step and the second sub-step of forming are preferably achieved by means of heat transfer.

Advantageously, in the step of firmly joining the first strip S1 of filtering material is joined to the rim 7 of the rigid body 2 by means of sealing, i.e. through heat transfer, by means of hot or cold gluing, or by means of ultrasounds.

The present invention further provides a machine 100 for making the intermediate components 11 of the single use capsules 1 for extraction or infusion beverages.

The machine 100 includes a feeding system 40 for feeding a first strip S1 of thermoformable filtering material; a transport system 50 for transporting the rigid bodies 2 along an advancing direction A, either singly or in form of a second strip S2 of thermoformable material on to which an orderly plurality of rigid bodies 2 has been achieved; and a joining station 60 adapted to firmly join the first strip S1 to the rigid bodies 2 at a joining zone along respective rims 7.

The second strip S2 may be continuous or discontinuous, to form an alveolate band or a plurality of alveo late trays, respectively.

Downstream of the joining station 60, the machine 100 includes a forming station 70 adapted to form the first strip S1 of filtering material to achieve a filtering element, or filter, 8 that defines a chamber 5 adapted to contain a dose D of product.

Depending on the operative requirements of the filling and packaging machines to which the intermediate components 11 are destined, the machine 100 may advantageously include at least one cutting station 110 to achieve single intermediate components 11, or trays comprising a plurality of intermediate components 11.

In a preferred embodiment, a single cutting station 110 may be provide for downstream of the forming station 70 to cut the first strip S1 of filtering material and the rigid body 2 (if the latter is fed in form of second strip S2) to achieve single intermediate components 11, or trays of intermediate components 11.

Alternatively, the machine 100 may not include cutting stations and the intermediate components 11 may be transferred to subsequent filling and packaging machines by means of the second strip S2, or by means of the first strip S1 in case the rigid bodies 2 are fed singly.

The feeding system 40 may comprise a feeding roll 25 for feeding the first strip S1 of filtering material and a idle roller 26 adapted to make the first strip S1 sliding upon the rigid bodies 2 along the advancing direction A.

Figure 1:
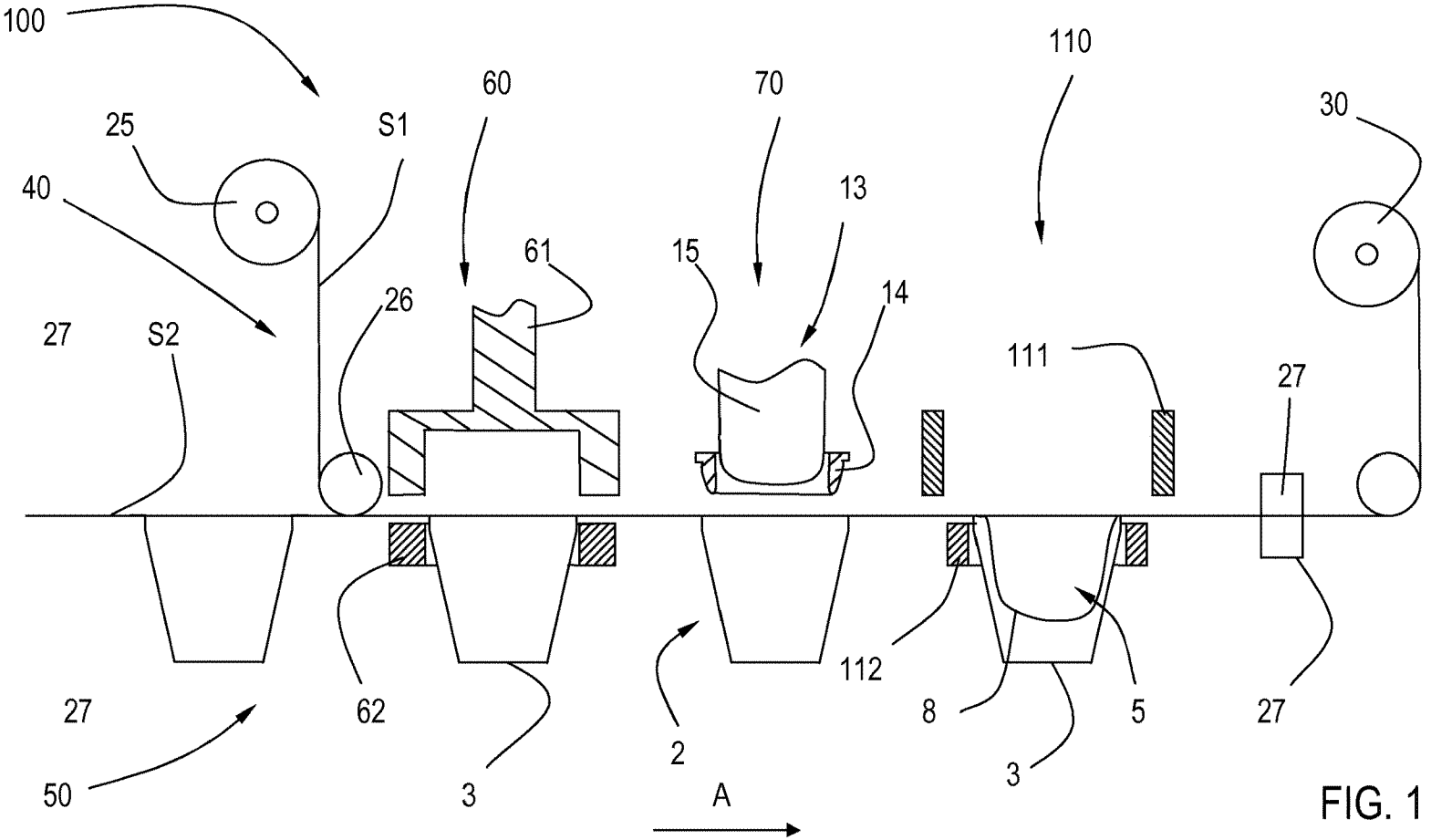
FIG. 1 is a schematic front view of a machine carrying out a method for making an intermediate component of a single use capsule for beverages of the extraction type according to the invention.

The transport system 50 may comprise movable drawers 9 adapted to house in suitable seats, and to move, the rigid bodies 2; or, in the embodiment in which the rigid bodies 2 are fed in form of the second strip S2, one or more pull clamps 27 (schematically illustrated in FIG. 1). In alternative embodiments not illustrated, the transport system 50 may comprise pulling rollers suitably shaped, at least one of which driven, to move the second strip S2 along the advancing direction A.

The joining station 60 may comprise one or more joining sealers 61 shaped to join the first strip S1 to the rim 7 of the rigid bodies 2 at an upper surface of the rim 7 that defines the joining zone. The joining sealers 61 can be reciprocatingly movable along a direction perpendicular to the advancing direction A of the first strip S1 and the rigid bodies 2. The joining station 60 may further comprise, below the rigid bodies 2, an abutment element 62 for cooperating with the joining sealers 61. Advantageously, in the embodiment illustrated in FIG. 2, the movable drawers 9 further acts as abutment element.

In an alternative embodiment, the joining station 60 may comprise a joining sealing roller, movable in rotation about an axis perpendicular to the advancing direction A. In such alternative embodiment, the same movable drawers 9 can act as abutment element, or the abutment element may assume the shape of a counter-roller, movable in rotation about an axis perpendicular to the advancing direction and parallel to the axis of rotation of the joining sealing roller.

The joining station 60, in particular the joining sealers 61 and the joining sealing rollers, may operate in hot or cold conditions, or by means of ultrasounds.

The forming station 70 includes forming means 13 adapted to plastically deform the filtering element 8 to define the chamber 5.

The forming means 13 includes a forming punch adapted to plastically deform the filtering element 8 to define the chamber 5.

Advantageously, the forming means 13 includes a first, or pre-forming, punch 14 adapted to thermoform an annular zone 8*a* of the filtering element 8 adjacent and internal to the joining zone (FIGS. 5 and 7), and a second, or final forming, punch 15 adapted to thermoform a central zone of the filtering element 8 internal to the annular zone 8*a* (FIGS. 6 and 8).

The first punch 14 includes a heated ring element with a respective external contact surface, inclined and configured for thermoforming the annular zone 8*a* of the filtering element 8. The first punch 14 is movable in a direction perpendicular to the advancing direction A, between an operative position wherein it contacts and thermoforms the first strip S1 penetrating within the rigid body 2 and an inoperative position far away from the first strip S1 and the rigid body 2. In substance, the first punch 14 allows to obtain a sort of "flaring" of the filtering element 8 so as to prepare the filtering material in the annular zone 8*a* to the subsequent complete thermoforming, so avoiding tears and cracks.

The second punch 15 includes a forming head featuring a respective contact surface, for example hemispherical, adapted to contact and thermoform the central zone of the filtering element 8, so as to define the chamber 5. The second punch 15 is movable parallelly to the first punch 14 in direction perpendicular to the advancing direction A, between an operative position wherein it contacts and thermoforms the first strip S1 penetrating within the rigid body 2 and an inoperative position far away from the first strip S1 and the rigid body 2. In substance, the second punch 15 completes the thermoforming of the filtering element 8.

Figure 5:
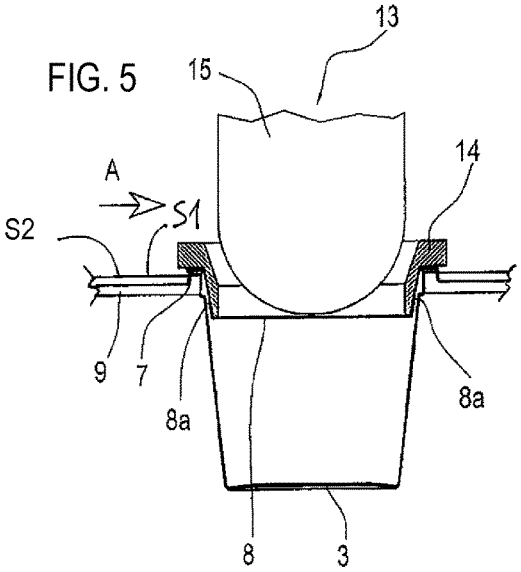
FIGS. 5 and 6 illustrate a step of forming a filtering element of an intermediate component in the machine of FIG. 2, in a schematic front view, with some parts cut away for sake of clearness.

In the embodiment illustrated in FIGS. 1, 5 and 6, the first punch 14 and the second punch 15 are coaxial and operatively coupled to pre-form and subsequently completely form the filtering element 8. In detail, the second punch 15 is dimensioned to slide within the first punch 14, after the latter has pre-formed the filtering element 8.

Figure 7:
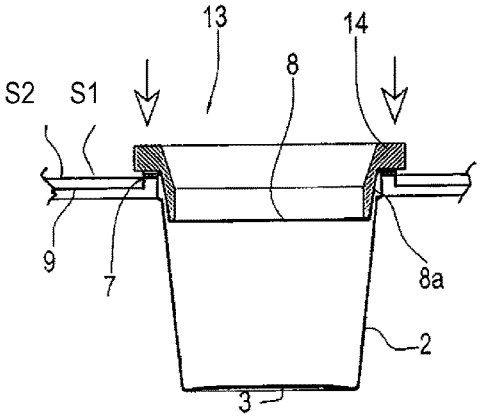
FIGS. 7 and 8 illustrate a different embodiment of the step of forming the filtering element of FIGS. 5 and 6, in a schematic front view.

In FIGS. 7 and 8, there is illustrated an alternative embodiment, in which the second punch 15 is arranged downstream of the first punch 14 along the advancing direction A.

In the embodiments illustrated in the figures, the second punch 15 does not contact the annular zone 8*a*. In an alternative embodiment not illustrated, in case the first punch 14 and the second punch 15 are not coaxial, the second punch 15 may have dimensions adapted to contact both the central zone and the annular zone 8*a* of the filtering element 8.

Therefore, in the embodiments illustrated, the filtering element 8 is formed by means of thermoforming in two subsequent steps.

In embodiments not illustrated, the forming station 70 may comprise forming means with a single forming punch, adapted to thermoform the filtering element 8 in a single step.

The cutting station 110, if present, may comprise a cutting organ, for example a shears 111, reciprocatingly movable along a direction perpendicular to the advancing direction A, and an associated abutment element 112 (see FIG. 1). Advantageously, in the embodiments illustrated in FIG. 2, the movable drawers 9 act as abutment element for the cutting organ.

Figure 2:
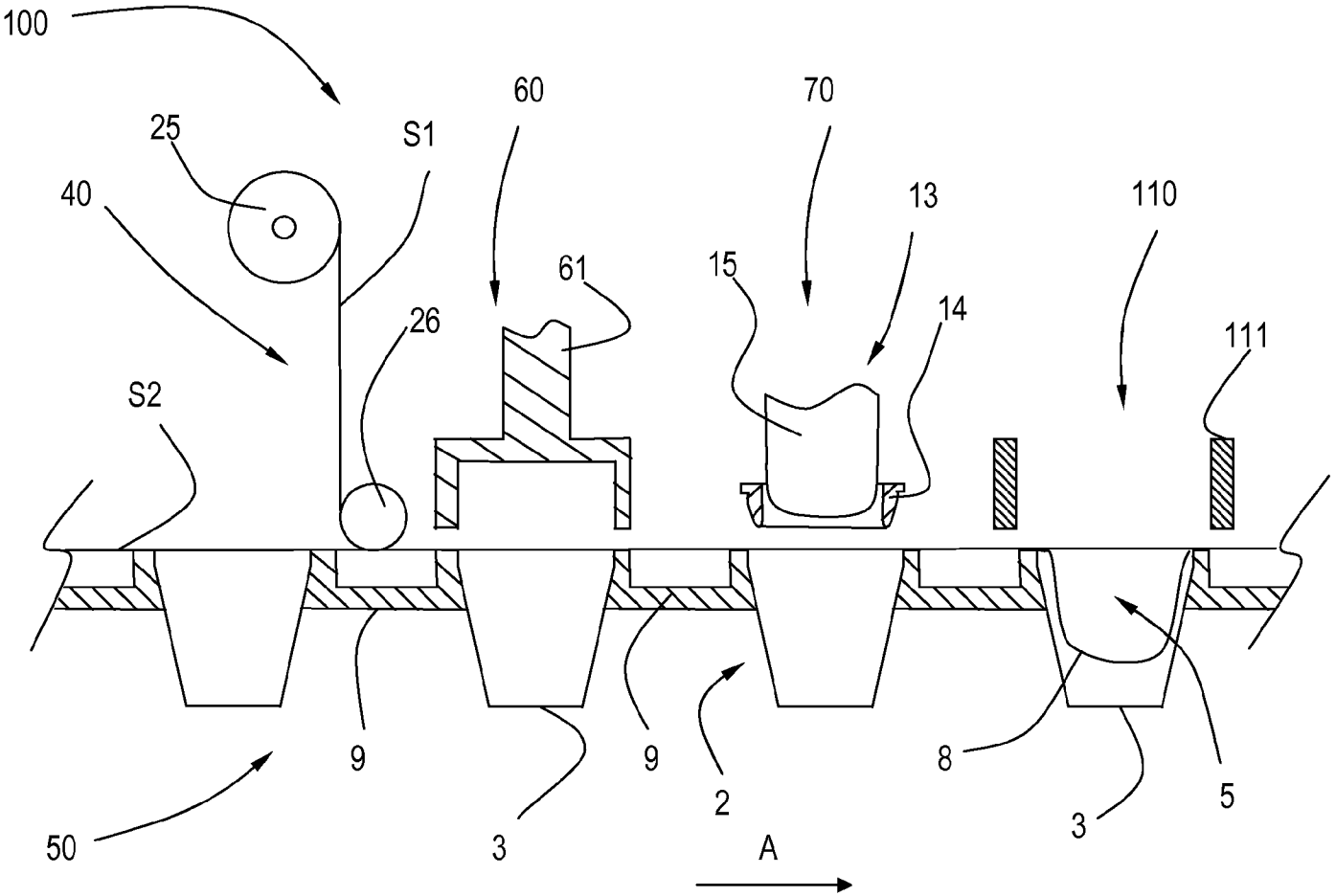
FIG. 2 is a different embodiment of the machine of FIG. 1.

The cutting station 110, illustrated downstream of the forming station 70 in FIGS. 1 and 2, may be interposed between the joining station 60 and the forming station 70 in an alternative embodiment.

The method and machine so conceived completely achieve the advantages set forth above.

The steps of joining and thermoforming the filtering element starting from a plane portion of filtering material allow to obtain an intermediate component of high quality. In fact, by operating on plane surfaces, it is possible to position the chamber relative to the rigid body in a very precise way and to obtain a better perimetral joining between the filtering element and the rim.

The invention claimed is:

1. Method for making intermediate components (11) of single-use capsules (1) for extraction or infusion beverages including a rigid body (2), cup-shaped and featuring a bottom (3) and an upper aperture (4) with a rim (7), and a filtering element (8) engaging the upper aperture (4) and configured to present a concavity within the rigid body (2) so as to define a chamber (5) adapted to contain a dose (D) of product, the rigid body (2) being impermeable to beverage, the filtering element (8) being effective as a filter for liquid, the method comprising the following steps, in sequence:

feeding a plurality of rigid bodies (2);

positioning a first strip (S1) of thermoformable filtering material above at least one of the rigid bodies (2);

joining the first strip of thermoformable filtering material to the rim of the rigid body (2) at an upper surface of the rim that defines a joining zone wherein the portion of the filtering material which is joined is the joined portion of filtering material; and forming the filtering element (8) by plastic deformation to define the chamber (5) adapted to contain the dose (D) of product, wherein the step of joining precedes the step of forming and wherein the step of forming comprises:

a first sub-step of thermoforming an annular zone (8*a*) of the filtering element (8), the annular zone (8*a*) being the portion adjacent and internal to the joined portion of filtering material; and a second sub-step of thermoforming a central zone of the filtering element (8) until the filtering element (8) achieves a shape of the chamber (5) in its final configuration, wherein the central zone is different from and interior to the annular zone (8*a*) and wherein the second sub-step is separate from and subsequent to the first sub-step.

2. Method according to claim 1, wherein the step of feeding provides for feeding the rigid bodies (2) singly.

3. Method according to claim 1, wherein the step of feeding provides for feeding the rigid bodies (2) in form of a second strip (S2) of thermoformed alveolate material.

4. Method according to claim 1, including a step of cutting, downstream of the step of forming, to cut at least the first strip (S1).

5. Method according to claim 1, including a step of cutting of the first strip between the step of joining and the step of forming.

6. Method according to claim 1, wherein said step of joining is achieved by sealing, or hot or cold gluing, or by means of ultrasounds.

7. Method according to claim 1, wherein the first sub-step is completed before the second sub-step is commenced.

8. Method according to claim 1, wherein the first sub-step is performed by a first or pre-forming punch (14) which includes a heated ring element.

9. Method according to claim 8, wherein the heated ring element has an external contact surface which is inclined and configured for thermoforming and flaring the annular zone (8*a*).

10. Method according to claim 1, wherein the second sub-step is performed by a second punch (15) which includes a forming head which has an external contact surface which is configured to contact and thermoform the central zone of the filtering element (8) to define the chamber (5).

11. Method according to claim 10, wherein the first sub-step is performed by a first punch (14) which includes a heated ring element, and wherein the first punch (14) and the second punch (15) are coaxial.

12. Method according to claim 11, wherein the second punch (15) is dimensioned and operated to slide within the first punch (14).

13. Method according to claim 10, wherein the first sub-step is performed by a first punch (14) which includes a heated ring element, and wherein the second punch (15) is arranged downstream of the first punch (14) along an advancing direction (A).

14. Method according to claim 10, wherein the second punch (15) does not contact the annular zone (8*a*).

* * * * *